US011589674B2

(12) United States Patent
Culveyhouse

(10) Patent No.: US 11,589,674 B2
(45) Date of Patent: Feb. 28, 2023

(54) SIDE RAIL MOUNTED ORGANIZER

(71) Applicant: Donald E. Culveyhouse, Elkhart, IN (US)

(72) Inventor: Donald E. Culveyhouse, Elkhart, IN (US)

( * ) Notice: Subject to any disclaimer, the term of this patent is extended or adjusted under 35 U.S.C. 154(b) by 0 days.

(21) Appl. No.: 16/992,976

(22) Filed: Aug. 13, 2020

(65) Prior Publication Data

US 2021/0059400 A1 Mar. 4, 2021

Related U.S. Application Data

(60) Provisional application No. 62/888,192, filed on Aug. 16, 2019.

(51) Int. Cl.
*A47B 23/02* (2006.01)
*A61G 7/05* (2006.01)

(52) U.S. Cl.
CPC ..... *A47B 23/025* (2013.01); *A61G 7/0503* (2013.01); *A61G 7/0524* (2016.11)

(58) Field of Classification Search
CPC .... A47B 23/025; A47B 23/02; A61G 7/0503; A61G 7/0524
USPC ..... 5/507.1, 503.1, 658, 663
See application file for complete search history.

(56) References Cited

U.S. PATENT DOCUMENTS 1,267,046 A * 5/1918 Beaird ..... A47B 5/04 108/135
1,797,847 A * 3/1931 Vandagriff ..... A47B 23/02 108/49
1,862,237 A * 6/1932 Pepler ..... A47B 23/02 108/49
2,468,412 A * 4/1949 Schaefer ..... B60N 3/002 108/149
2,766,087 A * 10/1956 Marcus ..... A47D 7/007 108/49
3,054,122 A * 9/1962 Sarkus ..... A47B 23/02 108/49
3,276,045 A * 10/1966 Bement ..... A47B 23/02 108/49
3,346,125 A * 10/1967 Miller ..... A47B 23/02 211/86.01
3,473,772 A * 10/1969 Nilson ..... A61G 7/0503 248/214
3,586,276 A * 6/1971 O'Mahoney ..... A61G 7/0503 248/128
3,813,714 A * 6/1974 Sater ..... A61G 5/1094 108/49
3,889,663 A * 6/1975 Fryer ..... A61H 31/008 601/41
4,357,881 A * 11/1982 De Long ..... A47B 23/02 108/135

(Continued)

*Primary Examiner* — Robert G Santos
(74) *Attorney, Agent, or Firm* — Crump Law P.C.

(57) ABSTRACT

The organizer provides a convenient bed rail mounted carrier for patient items. The organizer uses integral press-fit clamp members that capture the bed rail to securely hold the assemblies to the bed rail. In certain embodiments, the organizers may take the form of a unitary rail caddy for holding various personal items, such as telephones and remote controls. In other embodiments, the organizers may take the form of a modular tray and caddy assembly with interchangeable components, such as mounting bases, tray tops and accessory holders.

13 Claims, 12 Drawing Sheets

(56) References Cited

U.S. PATENT DOCUMENTS 4,404,698 A * 9/1983 Koncelik ..... A47B 23/02 108/49
4,747,172 A * 5/1988 Hohol ..... A61G 7/05 206/557
4,998,277 A * 3/1991 Rioux, Jr. ..... H04M 1/04 248/214
4,998,700 A * 3/1991 McKaig ..... A47C 21/00 248/214
5,084,925 A * 2/1992 Cook ..... A61G 7/052 5/503.1
5,152,486 A * 10/1992 Kabanek ..... A61G 13/10 108/49
5,359,741 A * 11/1994 Lang ..... A47B 23/046 108/140
5,447,237 A * 9/1995 Carter ..... A61G 7/0503 206/370
5,845,351 A * 12/1998 Berta ..... A61G 1/04 5/626
6,829,793 B2 * 12/2004 Brooke ..... A61G 7/0507 5/663
7,523,900 B1 * 4/2009 Hlatky ..... A47B 23/02 108/102
7,559,522 B1 * 7/2009 Hlatky ..... A47B 23/02 108/1
8,915,478 B2 * 12/2014 Perez ..... F16M 11/32 248/439
9,687,402 B2 * 6/2017 Ellis ..... A61G 7/0507
2003/0051291 A1 * 3/2003 Brooke ..... A61G 7/0524 5/430
2010/0139005 A1 * 6/2010 Perez ..... F16M 11/42 5/658
2012/0304390 A1 * 12/2012 Perez ..... F16M 11/42 5/658
2016/0324708 A1 * 11/2016 Ellis ..... A61G 7/0507
2021/0059400 A1 * 3/2021 Culveyhouse ..... A47B 23/025

* cited by examiner

SIDE RAIL MOUNTED ORGANIZER

This application claims the benefit of U.S. Provisional Application No. 62/888,192 filed Aug. 16, 2019, the disclosure of which is hereby incorporated by reference.

This invention relates to a personal item organizer, and in particular, a tray mountable to the side rails of a medical bed and similar furniture.

BACKGROUND AND SUMMARY OF THE INVENTION

Most hospital beds have side railings that prevent patients from falling off the bed. Bed railings are often equipped with certain patient care conveniences, such as intercom "call" buttons and speakers. Heretofore, other patient conveniences, such as, telephones, television remote controls, food trays, water containers, urinals and other items are simply placed on separate tables positioned next to the bed. These bed-side tables can quickly become cluttered and items are frequently knocked from the tables by patients and care givers.

The organizer of this invention provides a convenient bed rail mounted carrier for patient items. Generally, the organizers are configured and shaped to fit the particular bed rails to which the trays detachably mount. The organizers allow convenience items, such as remote controls, telephones and liquid containers to be secured to the bed rail and readily available to the patient, while not cluttering the area around the hospital bed. Securing commonly dropped or spilled items on the assemblies helps reduce time wasted by care givers in responding to dropped or spilled items by securing those items in a clean and safe bed rail mounted carrier within reach of the patient. The organizers can be easily cleaned and disinfected, as well as detachable from the bed rail and stowed to provide an uncluttered area around the patient.

The organizers of this invention use integral press-fit clamp members that capture the bed rail to securely hold the assemblies to the bed rail. In certain embodiments, the organizers may take the form of a unitary rail caddy for holding various personal items, such as telephones and remote controls. In other embodiments, the organizers may take the form of a modular tray and caddy assembly with interchangeable components, such as mounting bases, tray tops and accessory holders.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
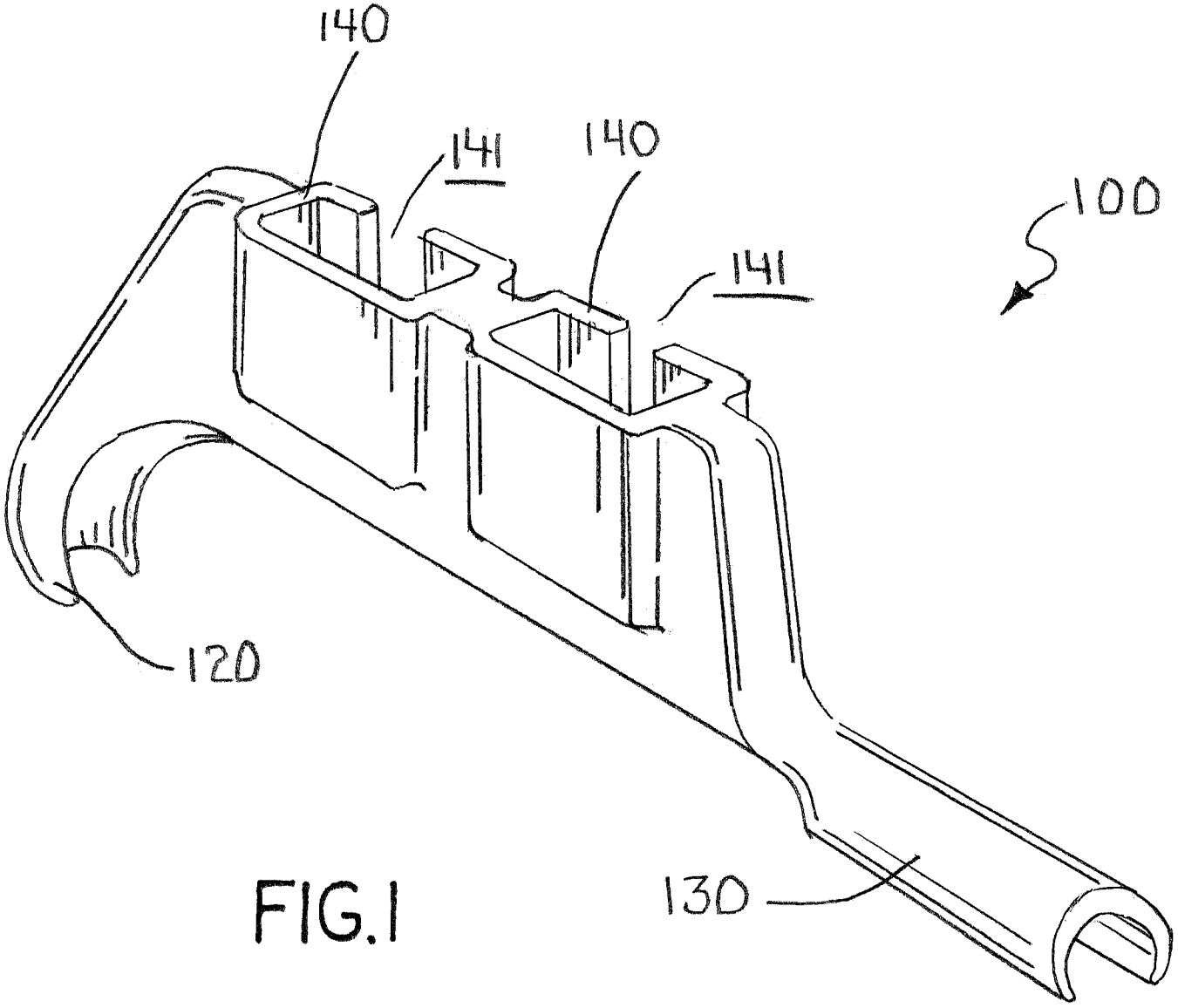
FIG. 1 is a perspective view of an exemplary embodiment of the organizer of this invention.
Figure 2:
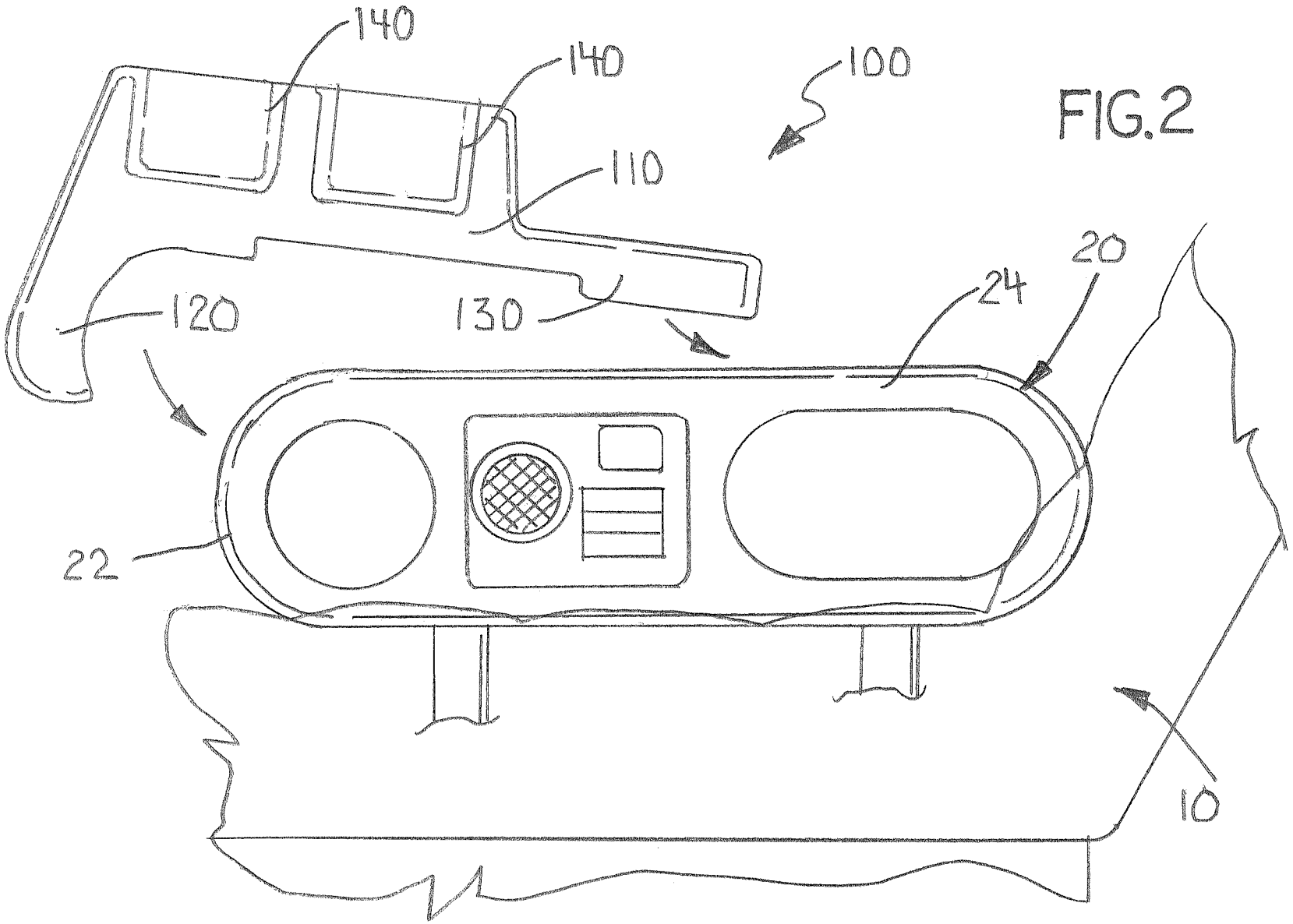
FIG. 2 is a side view of the organizer of FIG. 1 being mounted to the side rail of a conventional hospital bed.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The organizers of this invention provide various utility trays and holders for personal items detachably mounted to the side rails of conventional hospital beds and other beds and sitting furniture with side rails and the like. The organizers can be configured and dimensioned to accommodate the shapes and styles of any particular side rail and hospital bed. The trays may be adapted and modified to accommodate the shape, configuration and dimensions of any bed rail within the teaching of this invention. The organizers are generally constructed of a molded or formed plastic or composite of a suitable material, although may be constructed from stainless steel in certain embodiments. The material of the organizers is selected to be resistant to germs and bacteria, easily cleaned and disinfected, and have the structural resilience to provide a press-fit style connection with the particular bed rail.

For simplicity of explanation, the various embodiments of the organizers of this invention are illustrated in use on a generic hospital bed 10 with oval shaped side rails 20. As shown, side rails 20 have two arcuate ends 22 and straight top and bottom section 24. Rail 20 has a generally circular cross section at ends 22 and at certain portions of top section 22.

Figure 3:
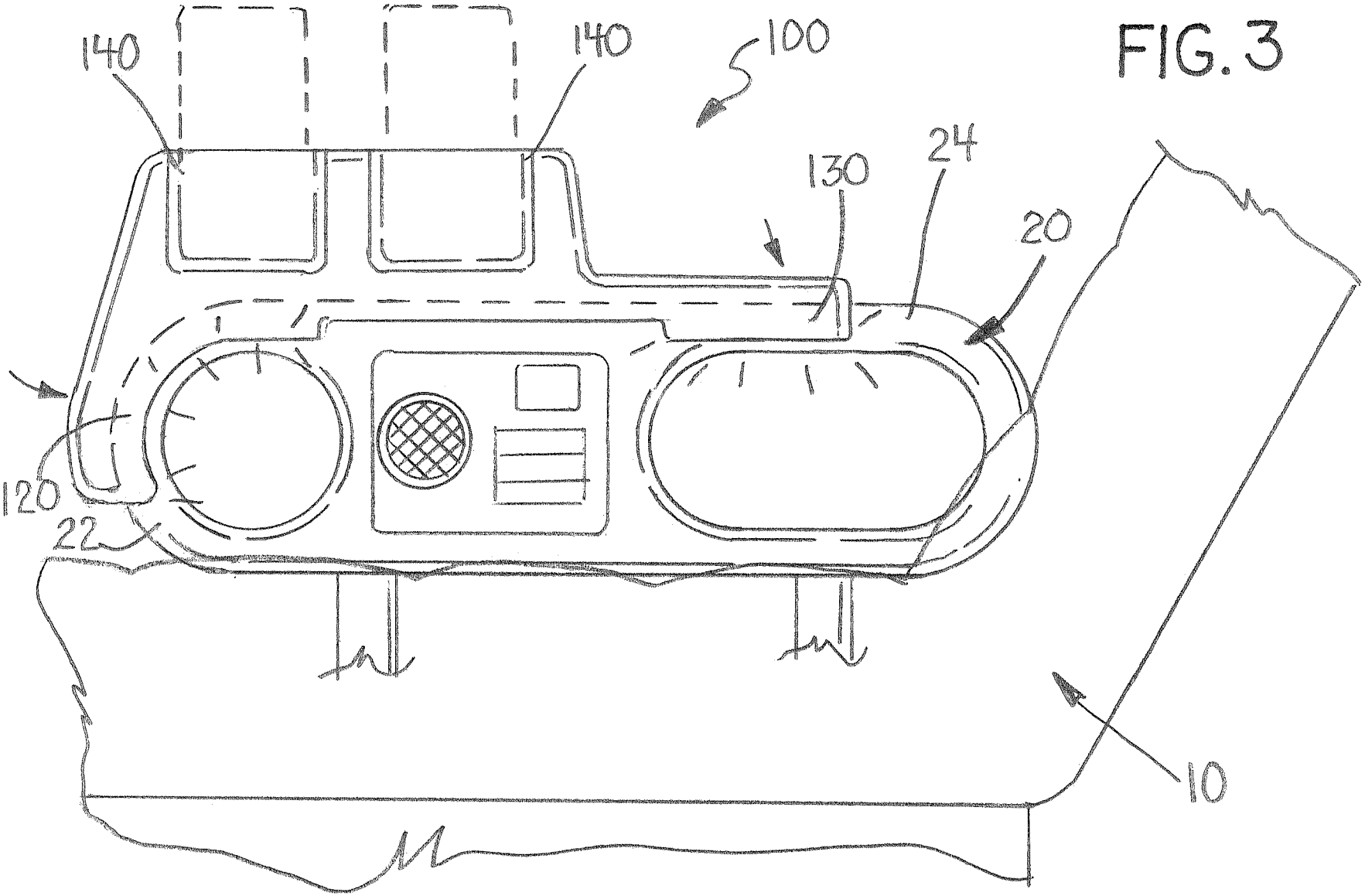
FIG. 3 is a side view of the organizer of FIG. 1 mounted to the side rail of a conventional hospital bed.
Figure 4:
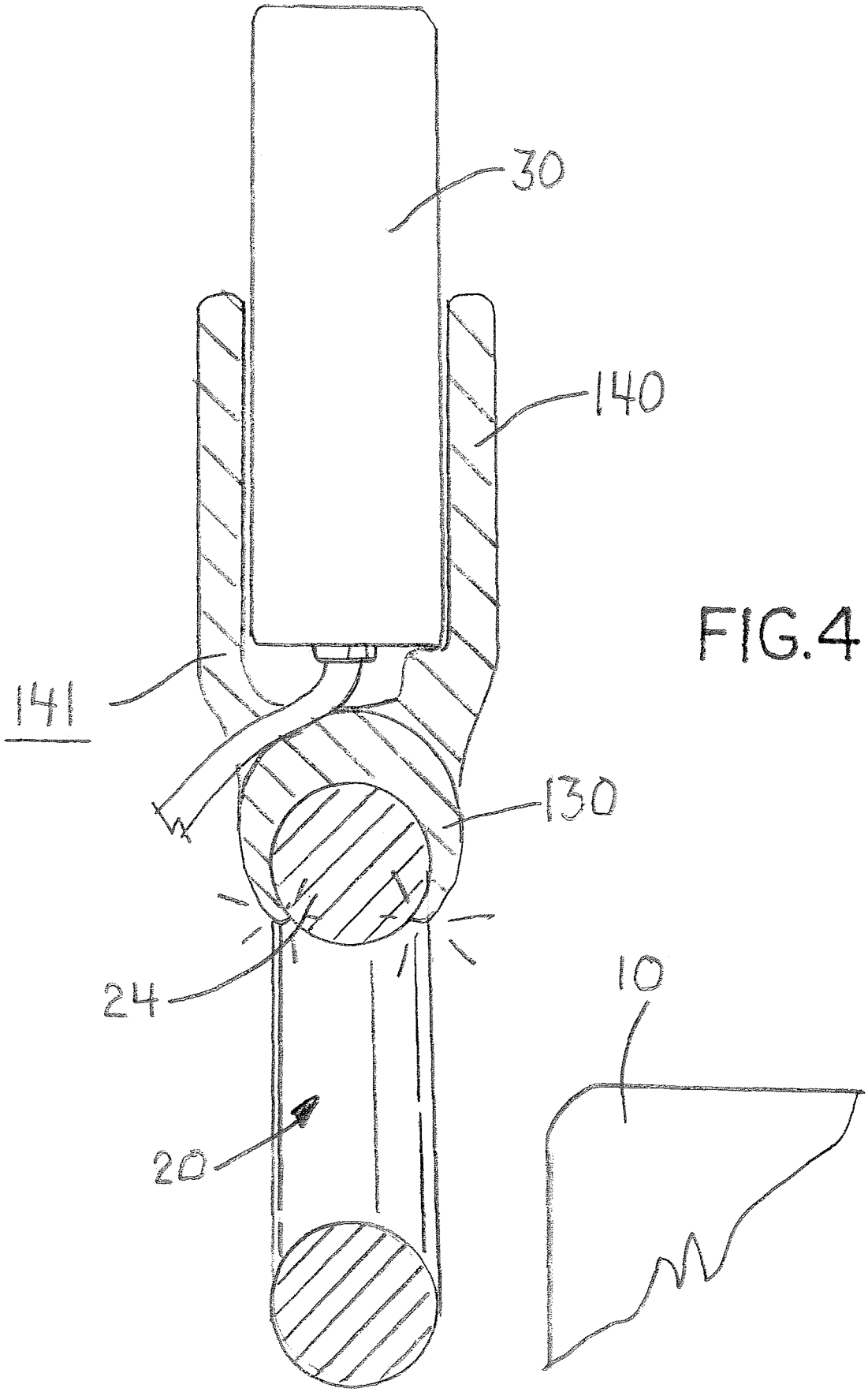
FIG. 4 is a side sectional view of the utility tray of FIG. 1 mounted to the side rail of a conventional hospital bed.
Figure 5:
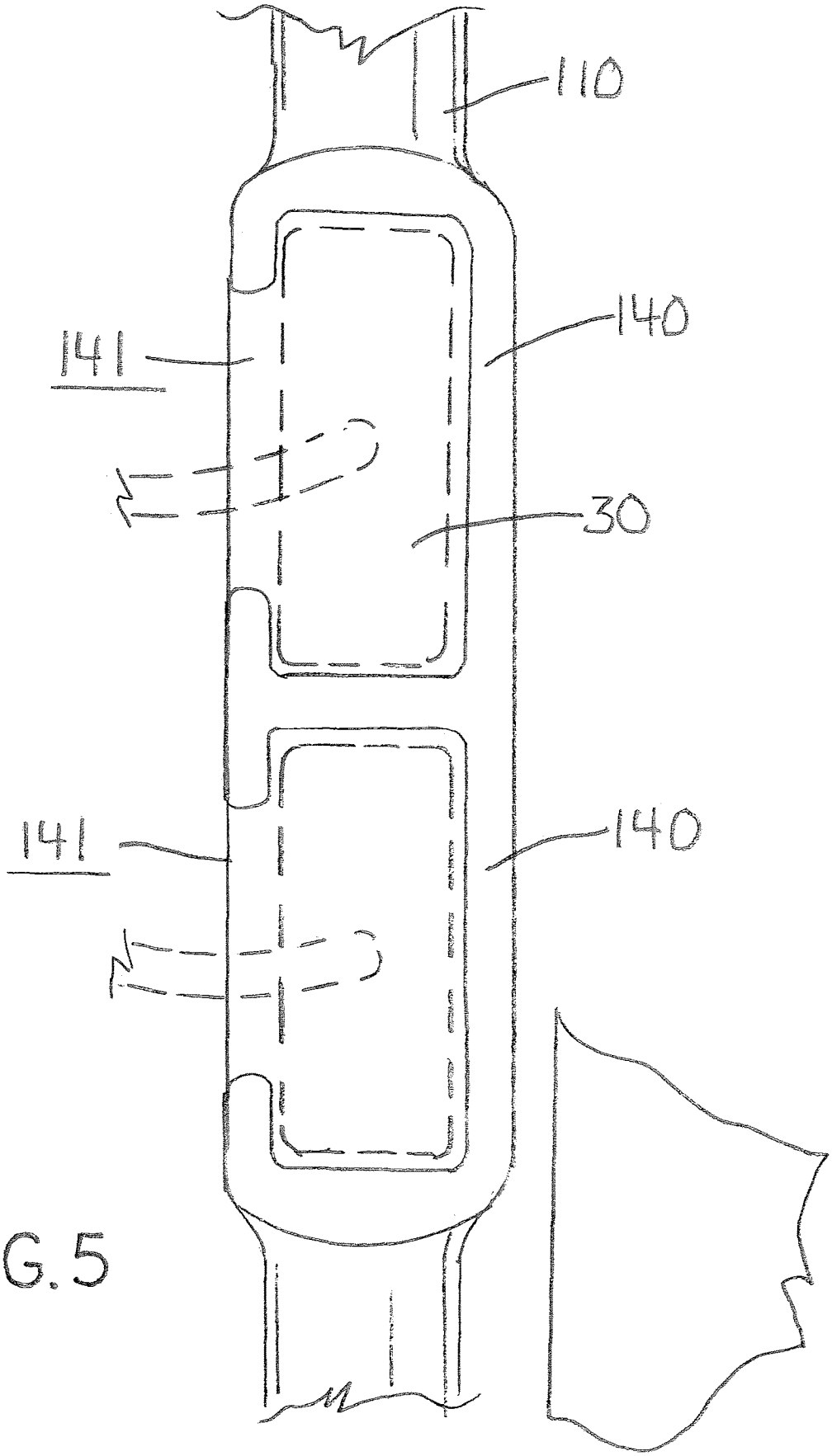
FIG. 5 is a top view of the organizer mounted to the side rail of a conventional hospital bed.

Referring now to the drawings, FIGS. 1-5 illustrate an exemplary embodiment of the organizer, which is designated generally as reference numeral 100. Organizer 100 takes the form of a rail mounted utility caddy and uses a unitary design. Organizer 100 has a caddy body 110 configured to couple to bed rail 20. Organizer 100 fits about bed rail 20 partially over top section 24 and one end 22 of the bed rail. Caddy body 110 has a recessed bottom contact surface 111 that mates with the circular cross-sectional contour of bed rail 20. The ends of caddy body 110 terminate with integral press-fit clamp members 120 and 130, which capture end 22 and top section 24 respectively. Each clamp member 120 and 130 has opposed arcuate clamp sides forming open channels that grip partially around bed rail 20 when organizer 100 is pressed against the bed rail. As shown in FIG. 3, clamp 120 restrictively seats against end 22 and clamp 130 against top section 24. Seating contact surface 111 of tray 100 atop bed rail 20 and interconnection of clamps 120 at the lateral limit of bed rail 20 and 130 along top section 24 securely holds organizer 100 to the bed rail in a fixed position. Caddy body 110 also has a plurality of item pockets 140 formed therein for receiving items, such as telephones and remote controls. Each pocket 140 is configured to have back wall opening 141 through which any item cords and wires pass. The back openings 141 also allow liquid to drain from the interior pockets 140.

Figure 6:
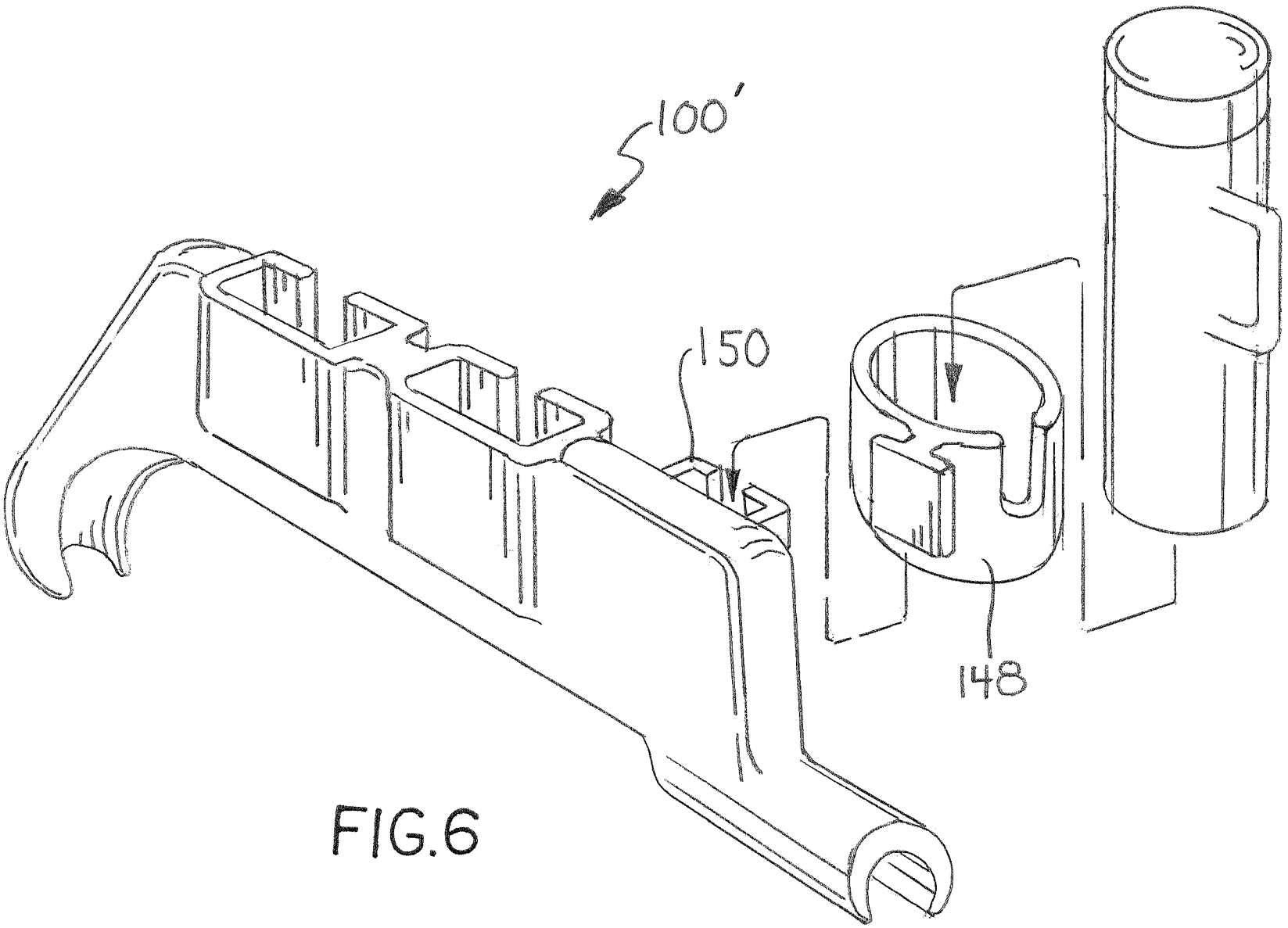
FIG. 6 is a perspective view of a second exemplary embodiment of the organizer having a detachable cup holder.

FIG. 6 illustrates an alternative exemplary embodiment of the organizer of this invention designated generally as reference number 100'. Organizer 100' again takes the form of a utility caddy and is identical to Organizer 100 in design and function. Organizer 100' adds an integrated mount interface 150 for detachably affixing a cup holder 148 or other additional item carries. As shown, interface 150 takes the form of a T-channel or dovetailed fitting, which allows corresponding mating cup holder 148 to be removably fitted to organizer 100.

Figure 7:
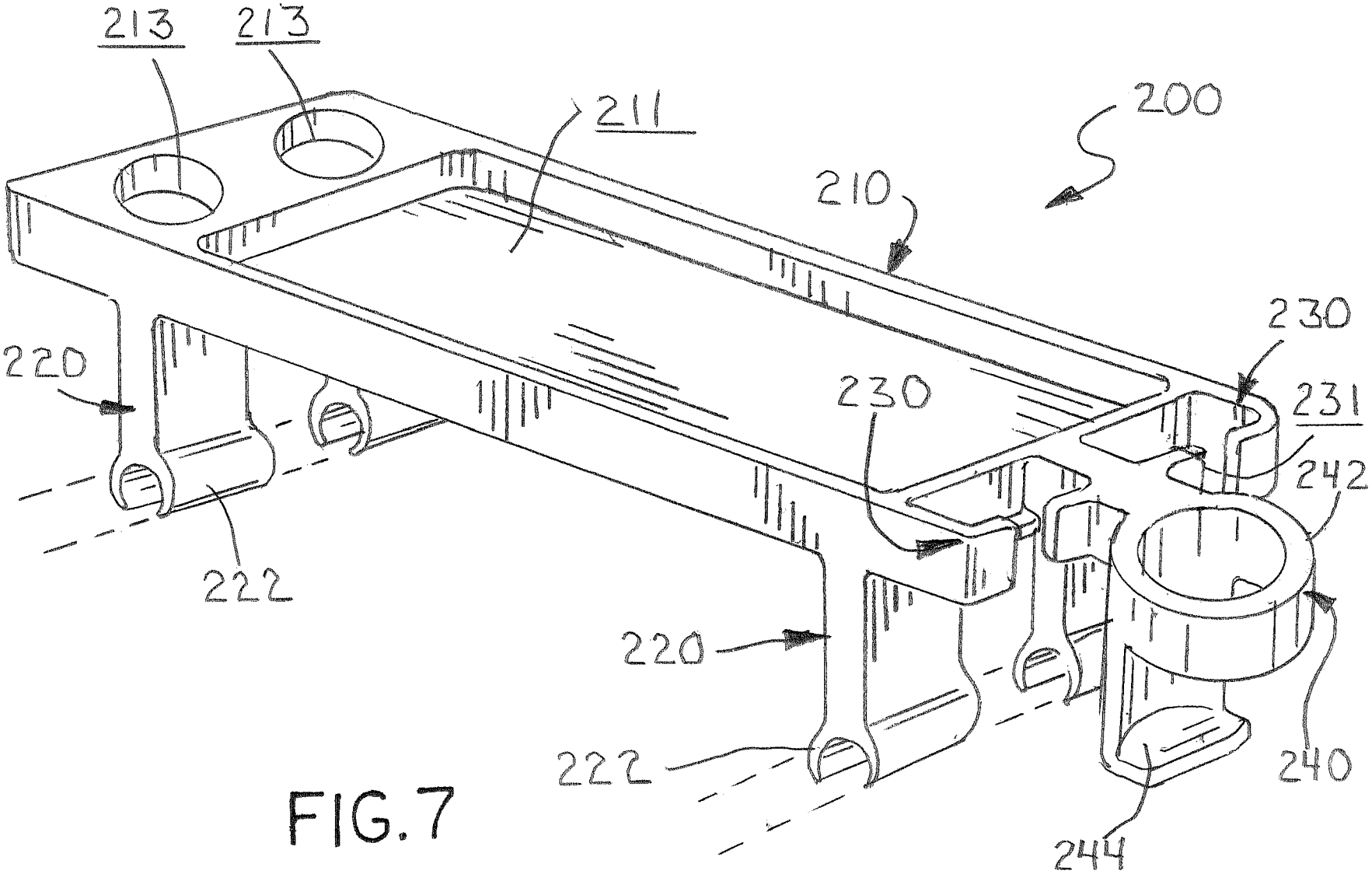
FIG. 7 is a perspective view of a third exemplary embodiment of the organizer of this invention.

FIG. 7 illustrates another exemplary embodiment of the organizer of this invention designated generally as reference number 200. Organizer 200 takes the form of an integrated tray and caddy and uses a unitary design configured and dimensioned to be detachably mounted between the bed rails. Organizer 200 includes a rectangular tray 210 supported between bed rails 20 by two sets of tray risers 220. Each set of risers 220 extend integrally from the bottom of tray 210 at opposite ends thereof. Each riser terminates with an integral press-fit clamp member 222, which captures top section 24 of bed rail 20. Each clamp member 222 has opposed arcuate clamp sides forming open channels that grip partially around bed rail 20 when organizer 100 is pressed against the bed rail. Tray 210 has a recessed main tray surface 211 and two recessed drink surfaces 213. Organizer also includes a pair of item pockets 230 and a cup holder 240 integrated into tray 210. Item pockets 230 are formed in tray 210 for receiving items, such as telephones and remote controls. Each item pocket 230 has a bottom flange (not shown), which supports items carried in the pocket and an opening 231 through which any item cords and wires pass. Cup holder 240 is formed in tray 210 for receiving a cylindrical drink container (not shown). Cup holder 240 includes an integral ring 242 and an open bottom flange 244 for supporting the bottom of the drink container.

Figure 8:
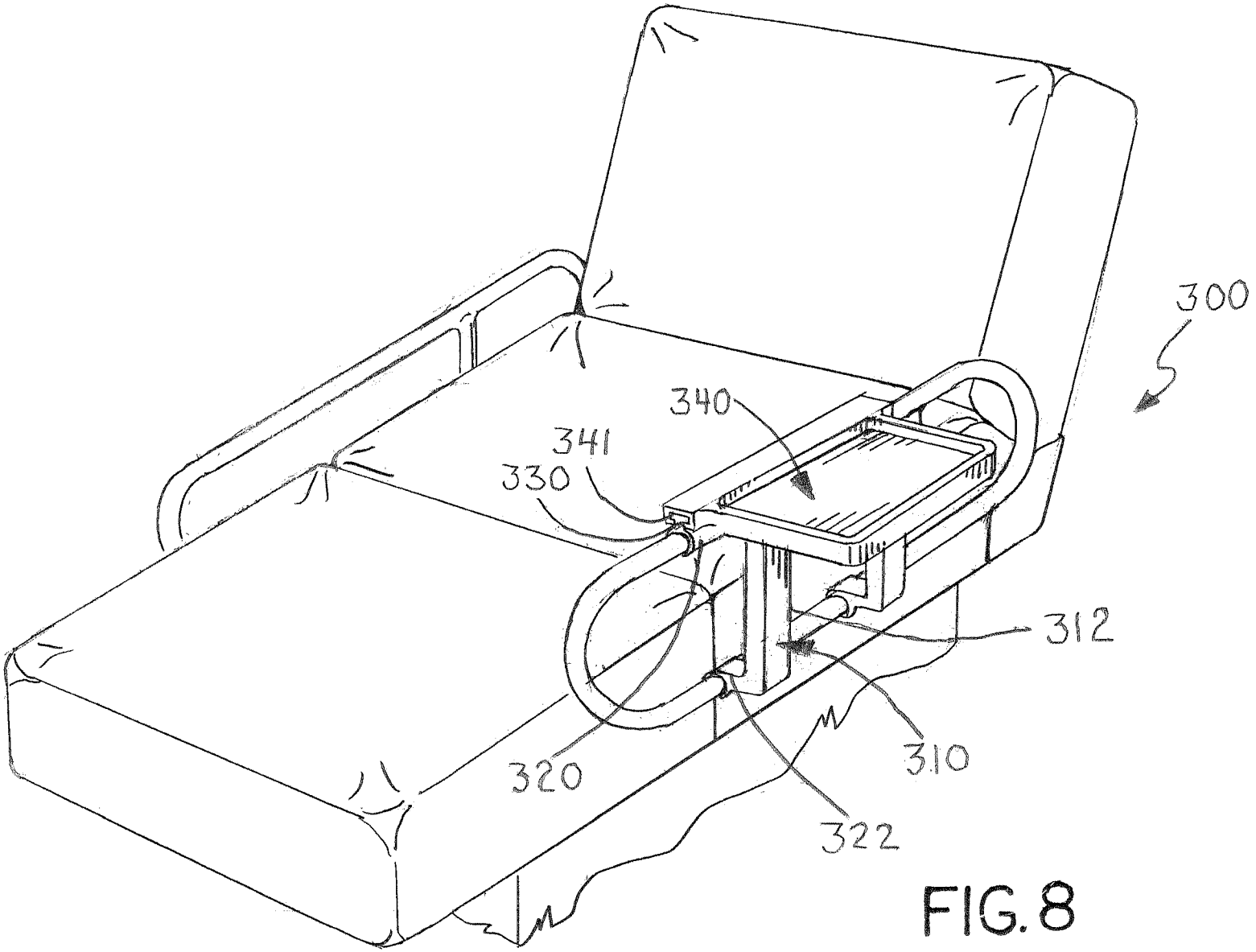
FIG. 8 is a perspective view of a third fourth exemplary embodiment of the organizer mounted to a hospital bed rail.
Figure 9:
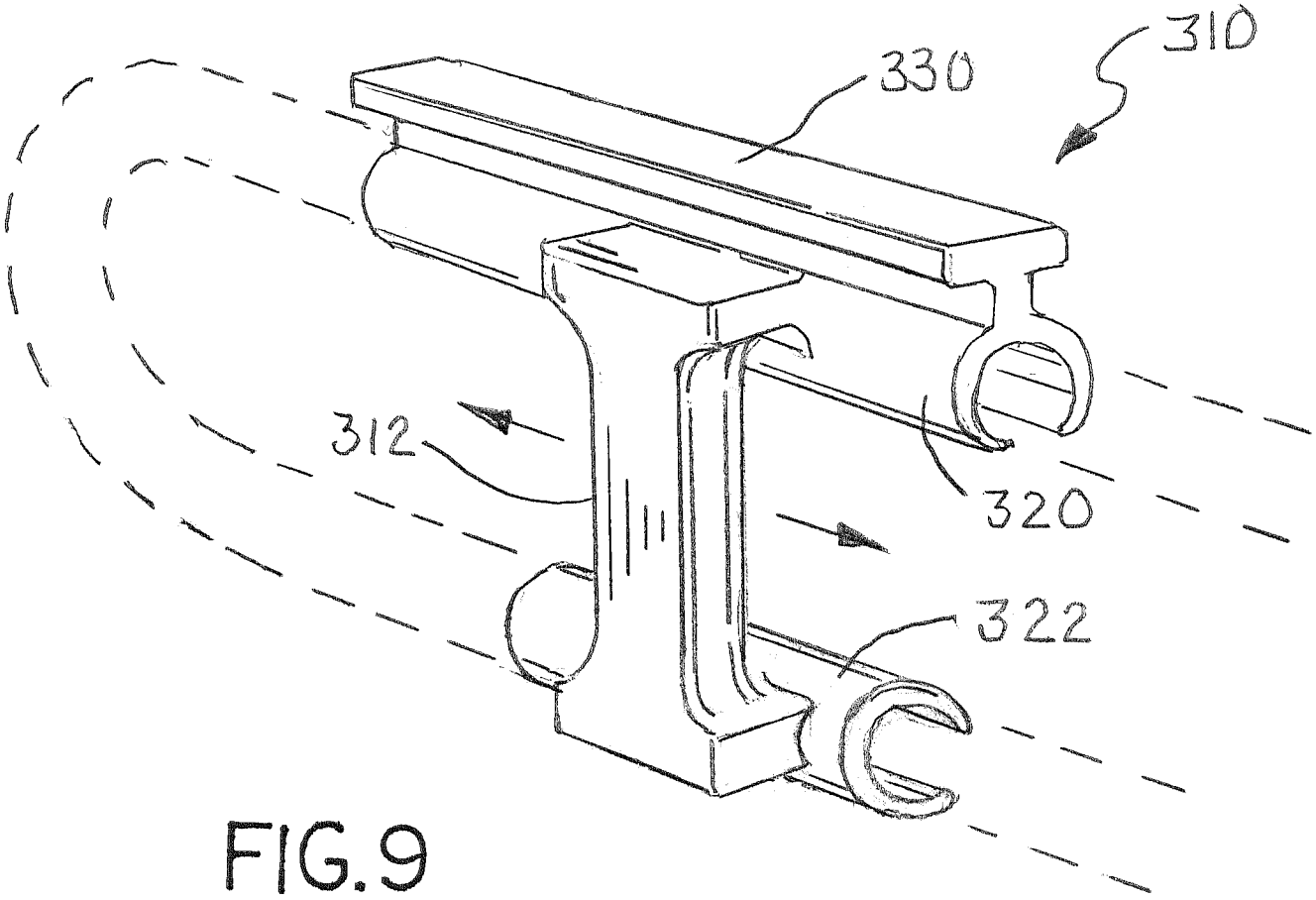
FIG. 9 is a perspective view of the mounting base of the organizer of FIG. 8.
Figures 10, 11, 12:
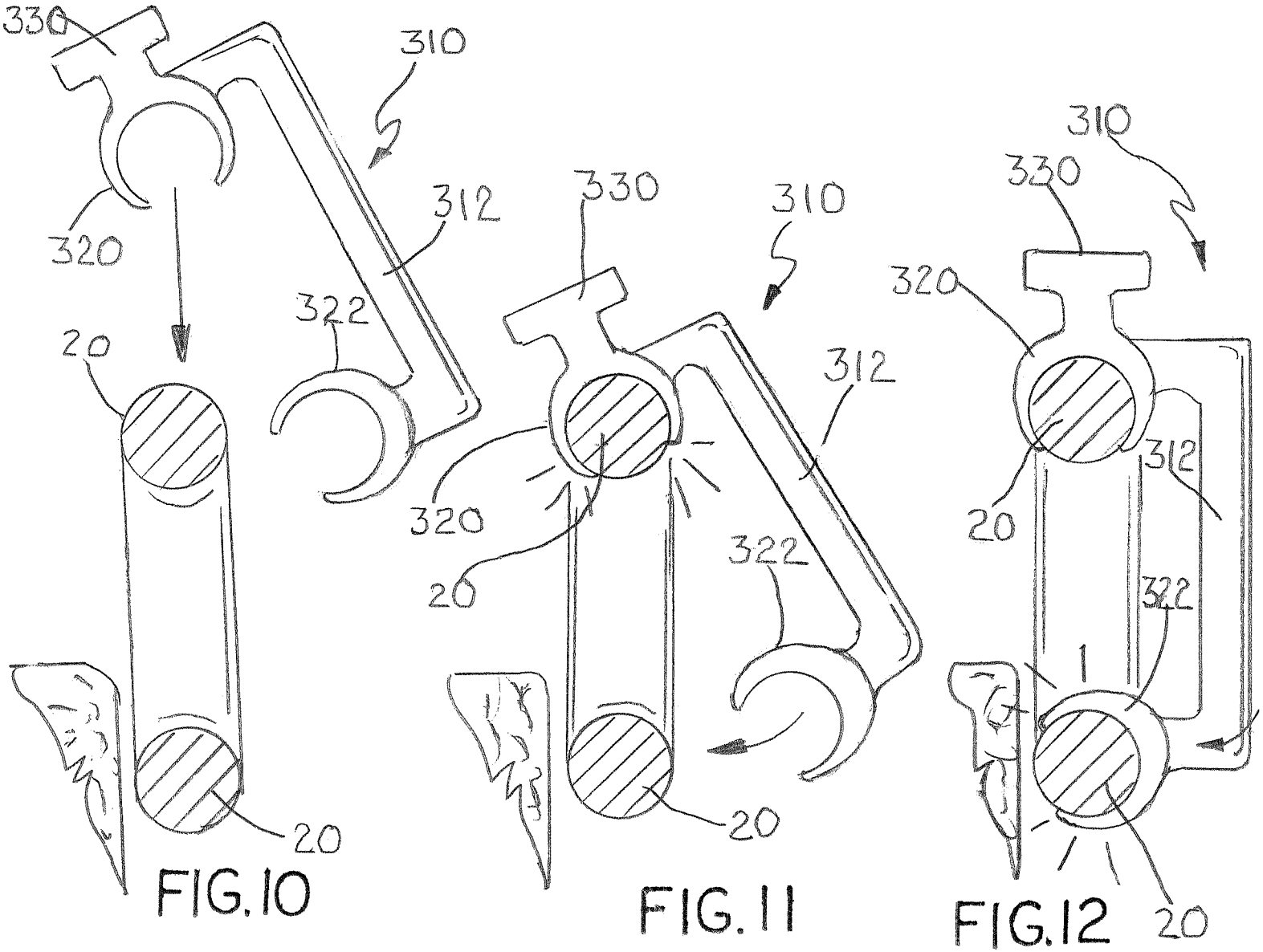
FIG. 10 is an end view of the mounting base of FIG. 8 being fitted to a bed rail.
FIG. 11 is an end view of the mounting base of FIG. 8 partially fitted to a bed rail.
FIG. 12 is an end view of the mounting base of FIG. 8 fitted to a bed rail.

FIGS. 8-16 illustrate an exemplary embodiment of the utility tray of this invention designated generally as reference number 300, which uses a modular design. As shown in FIG. 8, organizer 300 includes a mounting base 310 and detachable tray 340. Mounting base 310 has a pair of press-fit clamp members 320 and 322 integrally connected by a central cross member 312. Again, clamp member 322 has opposed arcuate clamp sides forming open channels that capture bed rail 20. Clamp member 320 has a bottom facing open channel for engaging over the top of uppermost bed rail 20 and clamp member 322 has a side facing open channel for engaging over the side of the lowermost bed rail 20. FIGS. 10-12 illustrate how clamp members 320 and 322 attach to bed rails 20. With mounting base 310 oriented at an angle to the plane of bed rails 20, clamp member 320 snaps over the top of the uppermost bed rail (FIG. 10). Once clamp member 320 is connected, mounting base 310 is pivoted to engage clamp member 322 to the lowermost bed rail 20 (FIG. 11). Clamp member 322 then snaps over the lowermost bed rail so that both clamp members lie in the plane of bed rails 20. Mounting base 310 also has an integral T-rail 330 protruding longitudinally across the top of clamp member 320. Tray 340 has an integral T-channel 341 formed along one edge of tray 340, which mates with T-rail 330 of mounting base 310. T-rail 330 and T-channel 341 provide the interface for detachably securing tray 340 to mounting base 310. Tray 340 slide slides onto mounting base 310 with the interface between T-rail 300 and T-channel 341 securely holding the tray in place.

Figure 14:
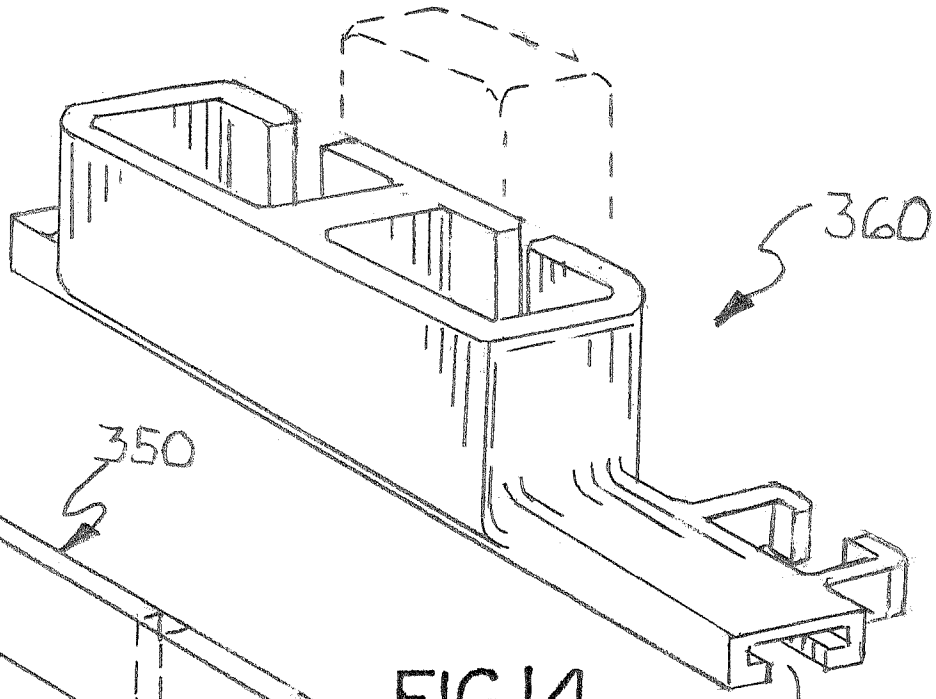
FIG. 14 is another exemplary embodiment of a dual article holder for use with the mounting base of FIG. 8.
Figure 13:
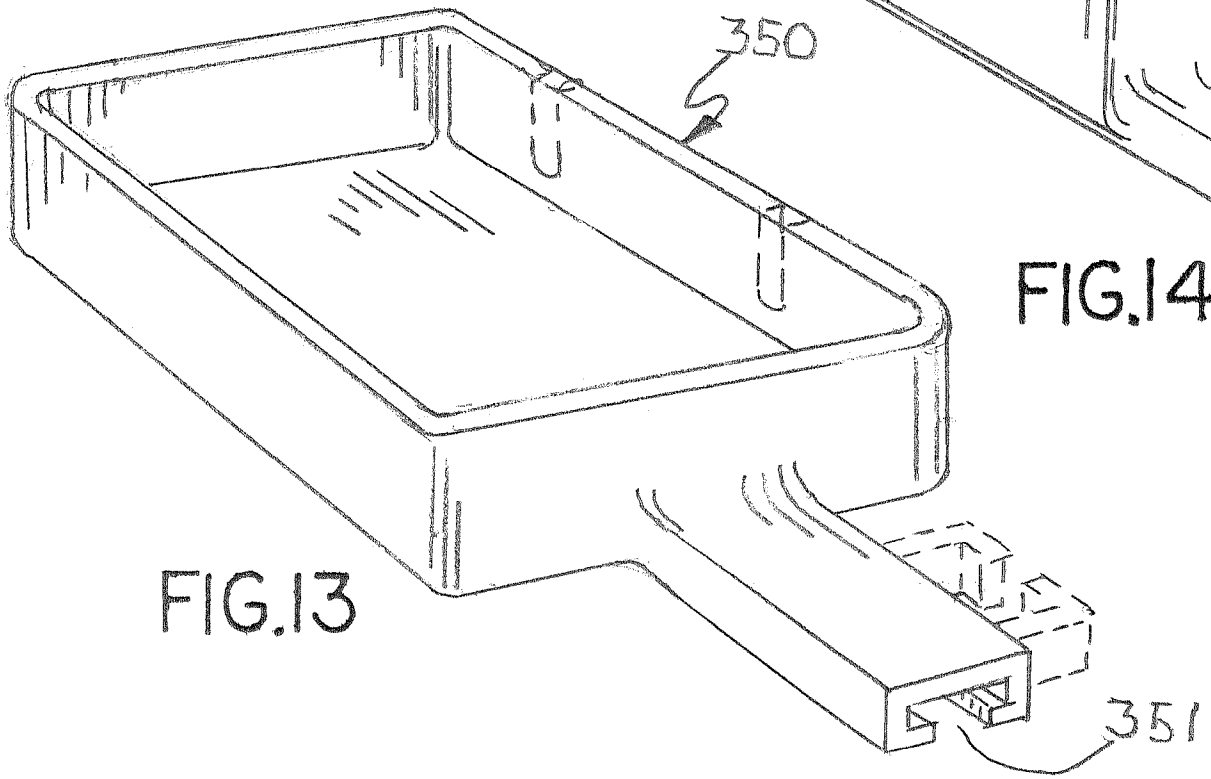
FIG. 13 is an alternative exemplary embodiment of a tray top for use with the mounting base of FIG. 8.

FIGS. 13 and 14 illustrate an embodiment of an alternative detachable tray 350 and utility caddy 360, which are adapted to connect to mounting base 310. Tray 350 and Caddy 360 each have T-channels 351 and 361. Again, the interface between T-rail 330 and T-channels 351 and 361 securely hold tray 350 and caddy 360 to mounting base 310.

Figure 15:
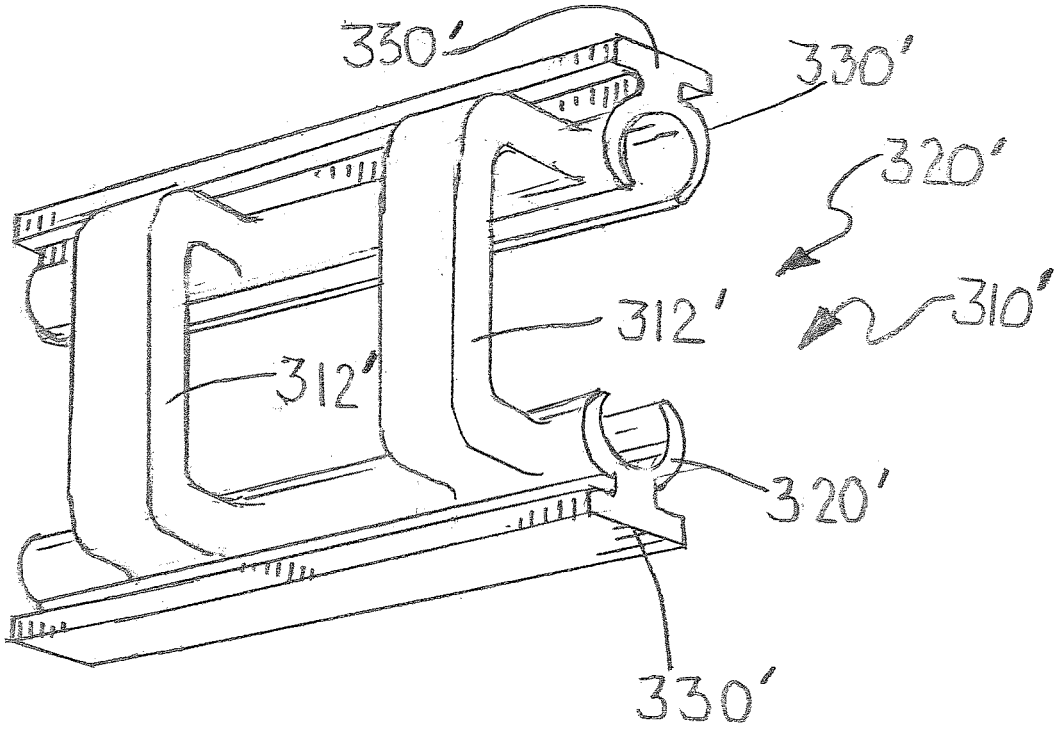
FIG. 15 is a perspective view of another exemplary embodiment of a mounting base of FIG. 8.
Figure 16:
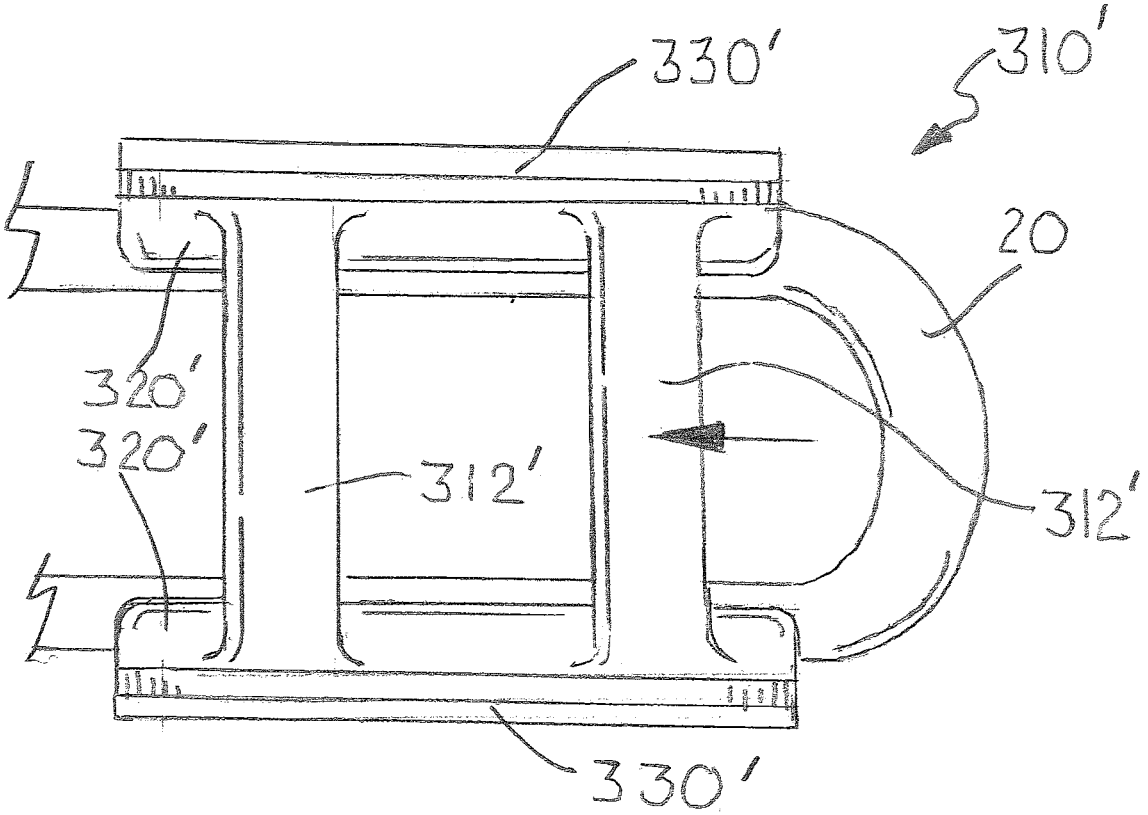
FIG. 16 is a side view of the mounting base of FIG. 15 fitted to a bed rail.

FIGS. 15 and 16 illustrate an alternative embodiment of mounting base 310' of organizor 300. Mounting base 310' is similar in design and function to mounting base 310. Mounting base 310' includes two cross members 312' connecting opposed clamp members 320' and two opposed T-rails 330' integrally protruding longitudinally across the clamp members. Clamp members 320' have facing open channels that allow mounting base 310' to slide laterally onto and over bed rails 20 (FIG. 16). Opposed T-rails 330' allow mounting base 310' to be reversed and mounted on bed rails 20 on either side of the bed.

One skilled in the art will note that the tray of this invention allows convenience items, such as remote controls, telephones and liquid containers to be secured to the bed rail and readily available to the patient, while not cluttering the area around the hospital bed. The organizers secure commonly dropped or spilled items, which reduces time wasted by care givers, securing those items in a clean and safe bed rail mounted carrier within reach of the patient. The organizers can be instantly removed from the bed rails and stowed to provide an uncluttered area around the patient. In addition, the design and construction of the organizers allow for easy cleaning and sterilization.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. An organizer detachably mountable to a side rail of a bed, where the side rail includes spaced parallel first and second portions and an arcuate end portion integrally connecting adjacent ends of the first and second portions, the organizer comprising:

an organizer body;

a first clamp member extending from the organizer body and configured to restrictively engage against the first portion of the side rail when the organizer is mounted to the side rail; and a second clamp member extending from the organizer body and configured to restrictively engage against a top surface of the arcuate end portion of the side rail when the organizer is mounted to the side rail.

2. The organizer of claim 1 wherein the organizer body has an internal pocket therein for receiving an item supported by the organizer.

3. The organizer of claim 1 wherein the organizer body includes a tray and a mounting base detachably connected to the tray.

4. The organizer of claim 3 wherein the first clamp member and the second clamp member extend integrally from the mounting base.

5. The organizer of claim 3 wherein the tray has one of an interface rail and a mating interface channel, the mounting base has the other of the interface rail and the mating interface channel, the interface rail and the mating interface channel constitute means for detachably connecting the tray and mounting base.

6. The organizer of claim 3 further comprising a detachable caddy for carrying items on the organizer, the caddy detachably connected to one of the tray and mounting base.

7. The organizer of claim 6 wherein the caddy has an internal pocket for receiving the items carried on the organizer.

8. The organizer of claim 1 wherein the organizer body includes a caddy for carrying items on the organizer and a mounting base detachably connected to the caddy.

9. The organizer of claim 8 wherein the first clamp member and the second clamp member extend integrally from the mounting base.

10. The organizer of claim 8 wherein the caddy has one of an interface rail and a mating interface channel, the mounting base has the other of the interface rail and the mating interface channel, the interface rail and the mating interface channel constitute means for detachably connecting the caddy and mounting base.

11. The organizer of claim 1 wherein each of the first clamp member and the second clamp member includes opposed arcuate clamp sides forming open channels for restrictively receiving the side rail.

12. The organizer of claim 11 wherein the open channel of the first clamp member is oriented perpendicularly from the open channel of the second clamp member.

13. An organizer detachably mountable to a side rail of a bed, where the side rail includes spaced parallel first and second portions and an arcuate end portion integrally connecting adjacent ends of the first and second portions, the organizer comprising:

an organizer body, the organizer body includes a tray and a mounting base detachably connected to the tray, the tray has one of an interface rail and a mating interface channel, the mounting base has the other of the interface rail and the mating interface channel, the interface rail and the mating interface channel constitute means for detachably connecting the tray and mounting base;

a first clamp member integrally extending from the mounting base and configured to restrictively engage against the first portion of the side rail when the organizer is mounted to the side rail, the first clamp member includes opposed arcuate clamp sides forming open channels for restrictively receiving the side rail;

a second clamp member integrally extending from the mounting base and configured to restrictively engage against a top surface of the arcuate end portion of the side rail when the organizer is mounted to the side rail, the second clamp member includes opposed arcuate clamp sides forming open channels for restrictively receiving the side rail; and a caddy for carrying items on the organizer, the caddy detachably connected to one of the tray and mounting base, the caddy has an internal pocket for receiving the items carried on the organizer, the caddy also has the one of an interface rail and a mating interface channel, the interface rail and the mating interface channel of the caddy also constitute means for detachably connecting the caddy and the mounting base.

* * * * *